US008708290B2

(12) United States Patent
Franta

(10) Patent No.: US 8,708,290 B2
(45) Date of Patent: Apr. 29, 2014

(54) LINE GUIDE

(76) Inventor: John E. Franta, Mesa, AZ (US)

( * ) Notice: Subject to any disclaimer, the term of this patent is extended or adjusted under 35 U.S.C. 154(b) by 239 days.

(21) Appl. No.: 13/199,584

(22) Filed: Sep. 2, 2011

(65) Prior Publication Data

US 2012/0056045 A1 Mar. 8, 2012

Related U.S. Application Data

(60) Provisional application No. 61/402,663, filed on Sep. 3, 2010.

(51) Int. Cl.
*F16L 3/22* (2006.01)

(52) U.S. Cl.
USPC ..... 248/68.1; 248/74.1; 248/219.3

(58) Field of Classification Search
USPC ..... 248/68.1, 71, 72, 74.4, 218.4, 219.3, 248/219.4, 231.9, 316.1, 316.5
See application file for complete search history.

(56) References Cited

U.S. PATENT DOCUMENTS

| | | | | | |
|---|---|---|---|---|---|
| 1,192,593 | A * | 7/1916 | Wolff | 248/68.1 |
| 3,856,244 | A * | 12/1974 | Menshen | 248/67.5 |
| 4,224,721 | A * | 9/1980 | Ohlson | 24/489 |
| 5,167,388 | A * | 12/1992 | Blair | 248/68.1 |
| 5,941,483 | A * | 8/1999 | Baginski | 248/68.1 |
| 6,540,531 | B2 * | 4/2003 | Syed et al. | 439/98 |

* cited by examiner

*Primary Examiner* — Gwendolyn W. Baxter
(74) *Attorney, Agent, or Firm* — Ronald R. Kilponen

(57) ABSTRACT

A two piece line guide is shown where the user can remove a pin or screw and rotate one portion of the line guide to open it and allow the user to install, remove or replace a line in the guide. In one embodiment the line guide opens in a vertical manner and in a second embodiment, the line guide opens in a horizontal manner. The line guides can be affixed to a flat surface while others can be affixed to a post or stanchion either with fasteners or lashings or both.

12 Claims, 17 Drawing Sheets

14
12
25
18
41
33
37
29
31
39
16
41
37
33
44

LINE GUIDE

CROSS REFERENCE TO RELATED APPLICATIONS

This application claims the benefit of Provisional Application for Patent Ser. No. 61/402,663 and having a filing date of Sep. 3, 2010.

FIELD

The present version of these embodiments relate generally to the field of line guides that are used in the marine industry and other areas.

BACKGROUND

These embodiments relate to quick release line guides and other line guides and more particularly to devices that can be used to help organize lines that are used in the marine industry. The marine industry and sailing in particular uses many lines mainly for sails but also for other devices. The lines generally run along the top of the deck back to the cockpit so that the captain or crew can raise and lower sails and other devices such as roller furlers.

Because there can be many lines on the deck they can become entangled or misplaced. It is important to know which line that you are pulling or releasing so that the sail or other device can take the correct action to maximize speed in racing for example.

It may also be important from a safety standpoint that the correct line is pulled or released at the appropriate time for safety reasons if the winds are high or weather is changing or to avoid a collision and many other reasons.

Sailors and boat operators need a way or device that can keep the lines placed at the same position in the cockpit or on the deck so that all who are adjusting them can make sure that they are taking the appropriate action at the appropriate time.

Line guides are one way of doing this. Most line guides are single pieces that have two screw or bolt holes through which are inserted bolts or screws and the line guides are attached to or through the deck or another fixed location. These line guides are solid blocks of material with holes through them for retaining the lines. The lines are then be run through the holes in the line guides. Many times there are several line guides along the deck so that a single line from the bow of the boat can be run to the cockpit of the boat and not become entangled or confused with another line on the deck. If the distance that the line needs to be run requires the use of two or more line guides then the lines need to be fed through each of the line guides individually by hand. This can be difficult if the line has a stopper knot to prevent the line from releasing from the line guides or the line is under tension as when under sail.

If a stopper knot is being used, then the knot must be untied, the line slipped through the hole in the line guide and the stopper knot tied again so that any tension on the line does not pull the line from the hole in the line guide. This is time consuming and somewhat hazardous if the line is released from the crew members grip and releases back through the line guide(s) to the bow for example where unintended results can occur. It can also be difficult to recover a line if it was attached to a sail and the released end is now blowing in the wind over the water.

Some marine operators use a furler which is a device that can roll up a sail if it is no longer needed and store the rolled sail in an upright position or stored below deck. This sail can then also be unrolled or unfurled by releasing one line while retaining a second line. Some furlers have two lines wrapped around a drum to furl and unfurl the sails. This can be problematic if the wind is blowing hard and some have trouble in running out of line before the sail is fully furled or rolled.

In other words, the wind can be blowing so hard that one cannot roll up the sail or one turn of the furler does not pull in the sail or pulls it in very little. This condition necessitates more line to spin the furler more revolutions which accordingly requires more line. One plans for the worst but some furlers, in windy conditions, cannot completely roll in a sail because there is a finite amount of line.

This problem has been address by using a loop of continuous line around the furler such that it is referred to as a continuous line furler. The line is looped back to the cockpit for instance and then by pulling on one end of this loop, the furler rolls up the sail and by pulling on the other end of the line, the furler unrolls the sail. In this circumstance the line never runs out as it is a loop and continuing to pull on the line will result in the action of the sail that is needed.

A continuous line furler, because the line is a loop, with the standard line guides, the line must be run through the line guides to the cockpit, one set of lines for the furling and one for the unfurling of the sail. The line is then spliced together to form the continuous loop. This requires the splicing of the furling line to be done on the boat. This can be inconvenient for the user to always have to have this continuous loop located at the same position on deck. Un-splicing and re-splicing the line to move to a different line guide is not a task that can be done quickly. If the line guides could open so that these continuous lines could be removed from the line guides and either placed in a different line guide or in a different location would be most convenient.

Other non-continuous lines could also be moved relatively easily and quickly from a first line guide to a second line guide with less risk of losing a line to the wind. By removing a line from one guide and placing it in a second guide and then removing the line from a third line guide and placing it in a fourth line guide the lines can be adjusted almost at the whim of the users.

For the foregoing reasons, there is a need for different types of line guides.

SUMMARY

In view of the foregoing disadvantages inherent in the traditional fixed line guides, there is a need for a quick release line guide where lines can be easily removed from one guide and placed into a second guide.

A first objective of these embodiments is to provide a device that can retain lines in a certain position.

Another objective of these embodiments is to provide a device that can be easily used to retain and release a line.

It is yet another objective of these embodiments to provide a device that is light in weight for holding lines.

It is a still further objective of these embodiments provide a device that be easily operated such that lines can be retained and released with less risk of releasing the line.

Another objective of these embodiments is to provide a device that is simple to operate.

Another objective of these embodiments is to provide a device that can be attached to replace traditional line guides.

These together with other objectives of these embodiments, along with various features of novelty which characterize these embodiments, are pointed out with particularity in this application forming a part of this disclosure. For a better understanding of these embodiments, the operating advantages and the specific objectives attained by its uses, reference should be had to the accompanying drawings, descriptive matter and claims in which there is illustrated a preferred embodiment.

DETAILED DESCRIPTION OF THE PREFERRED EMBODIMENTS

Figure 1:
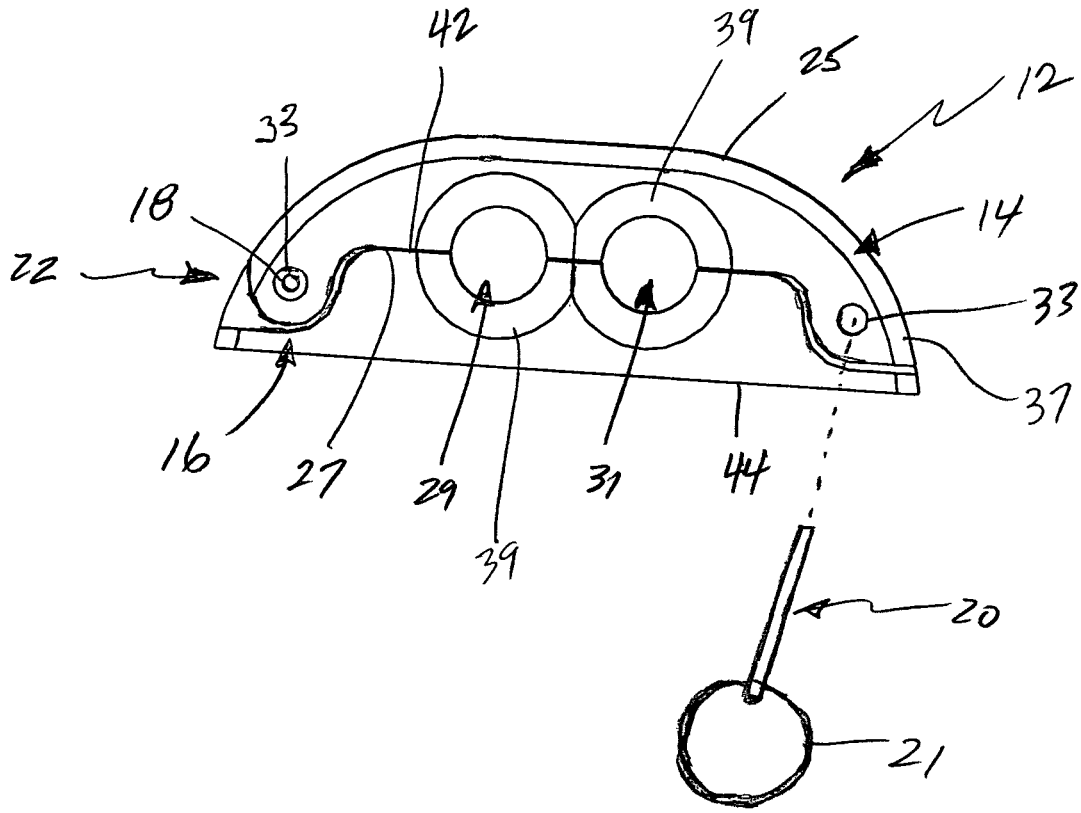
FIG. 1 shows a side view of one embodiment of a closed line guide.

Referring to the drawings in detail wherein like elements are indicated by like numerals, there is shown in FIG. 1 a line guide 12. The line guide 12 is comprised of generally two pieces the top half 14 and the bottom half 16. The top half 14 and bottom half 16 nest together and when nested form a first hole 29 and second hole 31 through which the ropes or lines are run. The first hole 29 and second hole 31 run side to side in the line guide 12. The top half 14 pivots on pivot pin 18 around and away from the bottom half 16 in a vertical direction, FIG. 4. The top half 14 is retained in the closed position with the bottom half 16 by a retention pin 20 having a ring 21. The retention pin 20 is inserted into the retention hole 33 in finger 37 of the top half 14, through the boss 41 in the bottom half 16 and into and through the opposite finger 37 in the top half 14, FIG. 3. The retention pin 20 can be a spring pin or a pin with a ball and spring on the distal end, known in the art.

The retention pin 20 retains the top half 14 and the bottom half 16 together allowing the lines (not shown) to be run through the first hole 29 and second hole 31 and continue to wherever the user desires. This also allows the user to install and remove lines from the line guide 12 as they desire.

Figure 2:
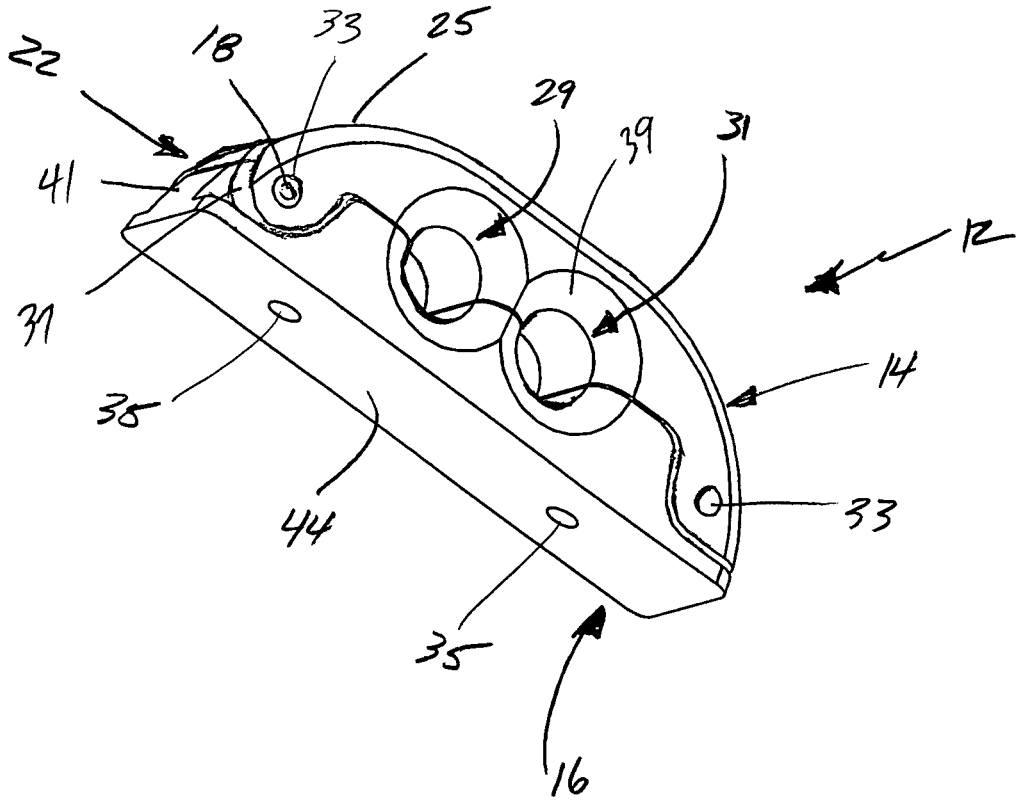
FIG. 2 shows a bottom perspective view of one embodiment of a closed line guide.
Figure 4:
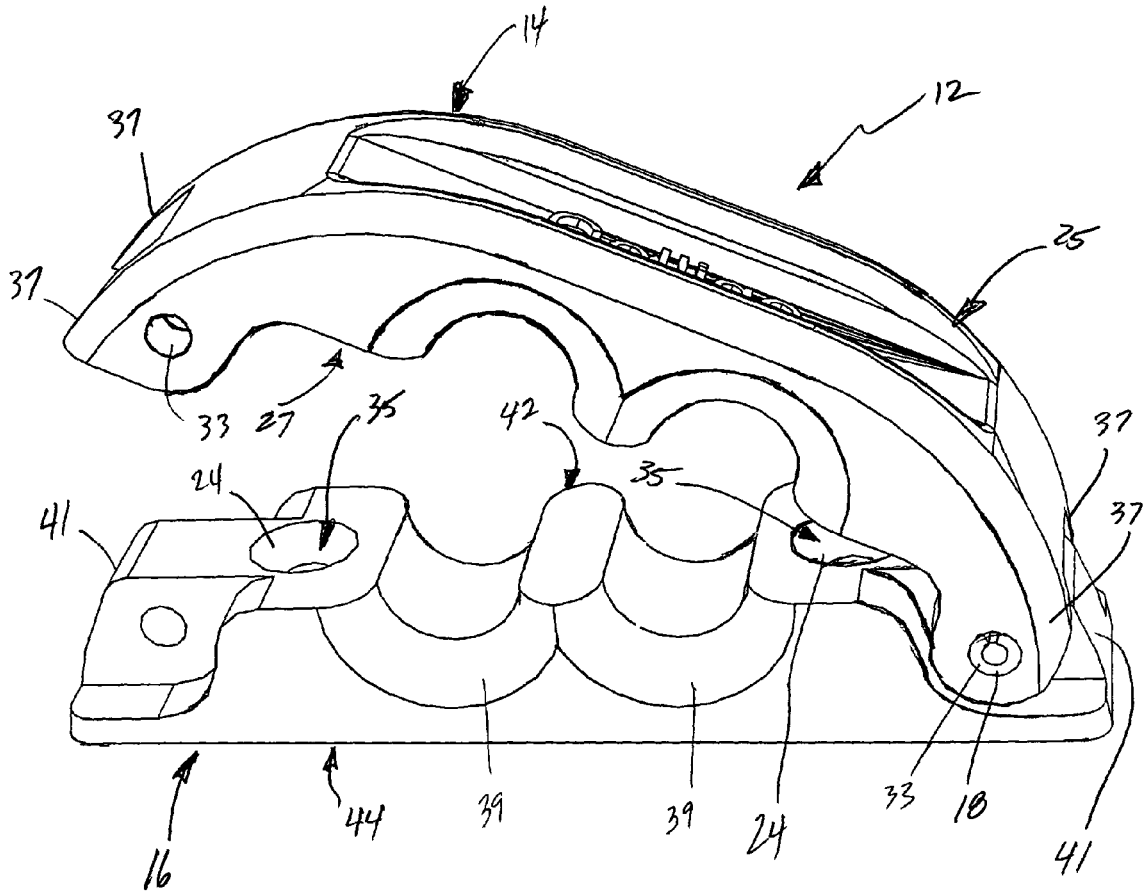
FIG. 4 shows a top perspective view of one embodiment of a line guide shown partially open.

FIG. 2 shows a bottom perspective view of the line guide 12. On the bottom 44 of the bottom half 16 are shown two fastening holes 35. More or fewer fastening holes 35 could be used. The fastening holes 35 receive a screw or bolt and nut and retain the line guide 12 to wherever the user wishes to mount the line guide 12. FIG. 4 shows the fastening hole 35 in the top 42 of the bottom half 16. The fastening holes 35 each have a chamfer 24 to house the head of the screw such that the head does not extend above the top 42 of the bottom half 16 and the top half 14 and bottom half 16 can be closed together without interference from the screws when located in the fastening holes 35.

Figure 3:
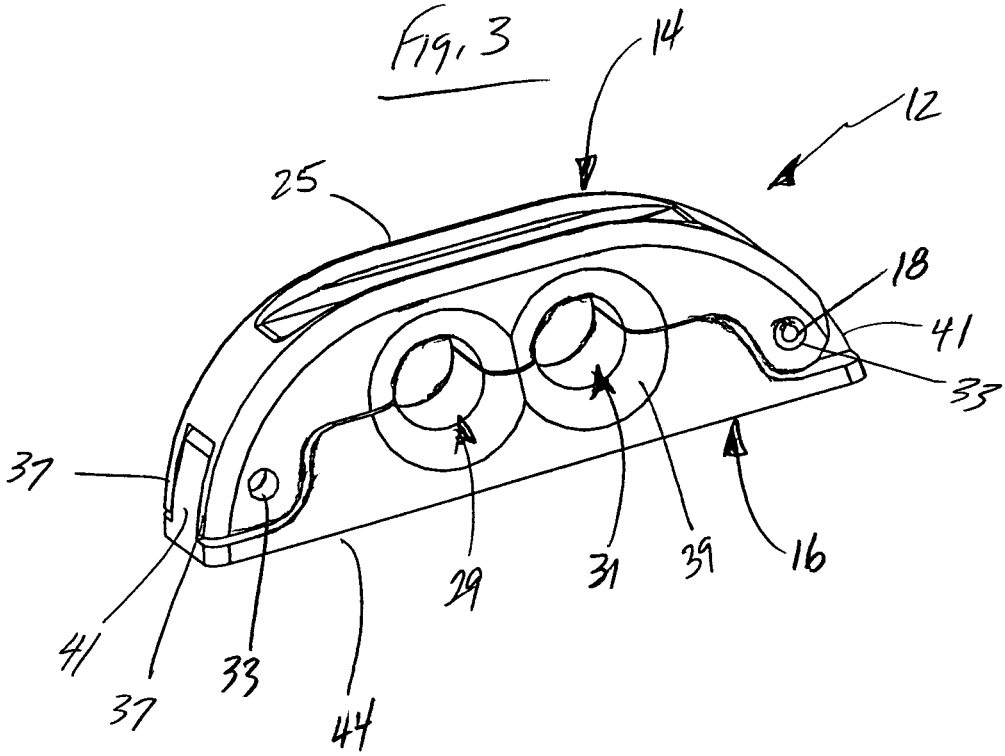
FIG. 3 shows a top perspective view of one embodiment of a closed line guide.

FIG. 3 shows a top perspective view of the line guide 12 in the closed position without the retention pin 20.

FIG. 4 shows a top perspective view of the line guide 12 partially open. The boss 41 in the bottom half 16 is clearly shown here and the top 42 of the bottom half 16 that contacts the bottom 27 of the top half 14 when the device is in the closed position.

Figure 5:
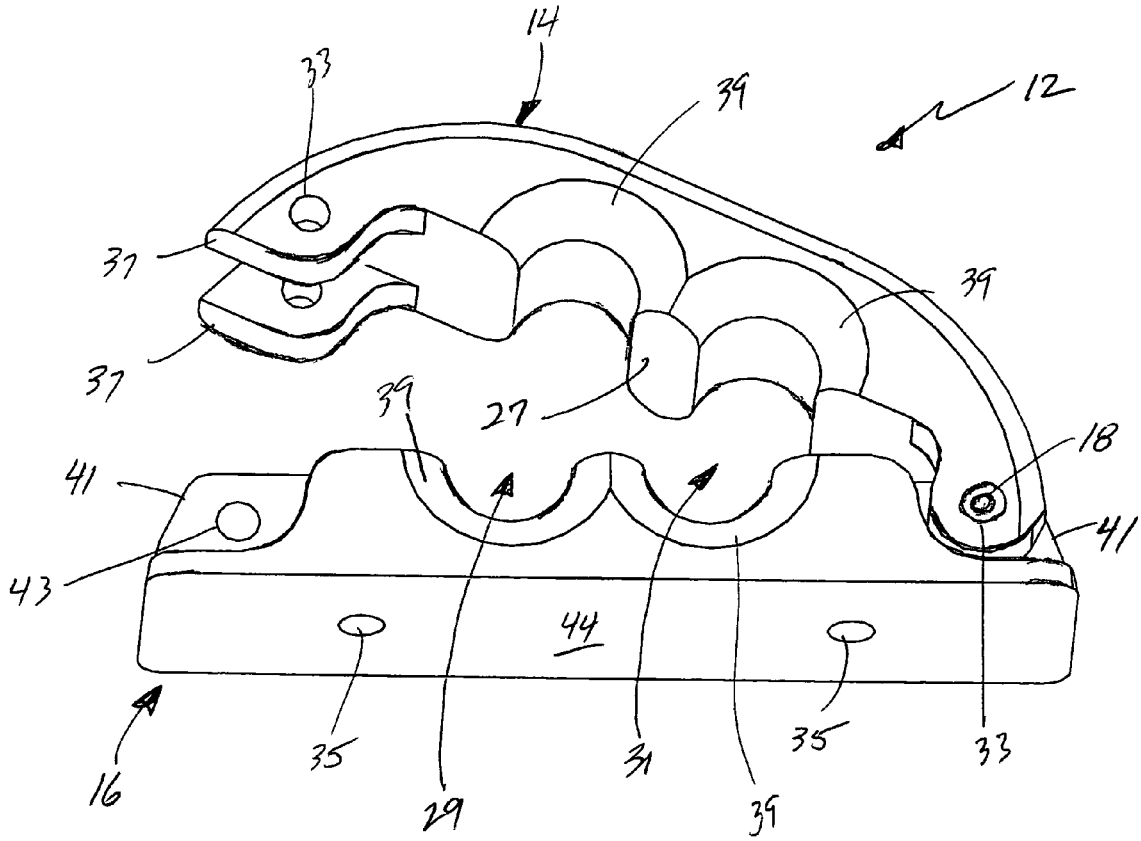
FIG. 5 shows a bottom perspective view of one embodiment of a line guide shown partially open.

FIG. 5 shows a bottom perspective view of the line guide 12 in a partially open position. The fingers 37 and the bottom 27 of the top half 14 are more clearly shown in this view.

Figure 6:
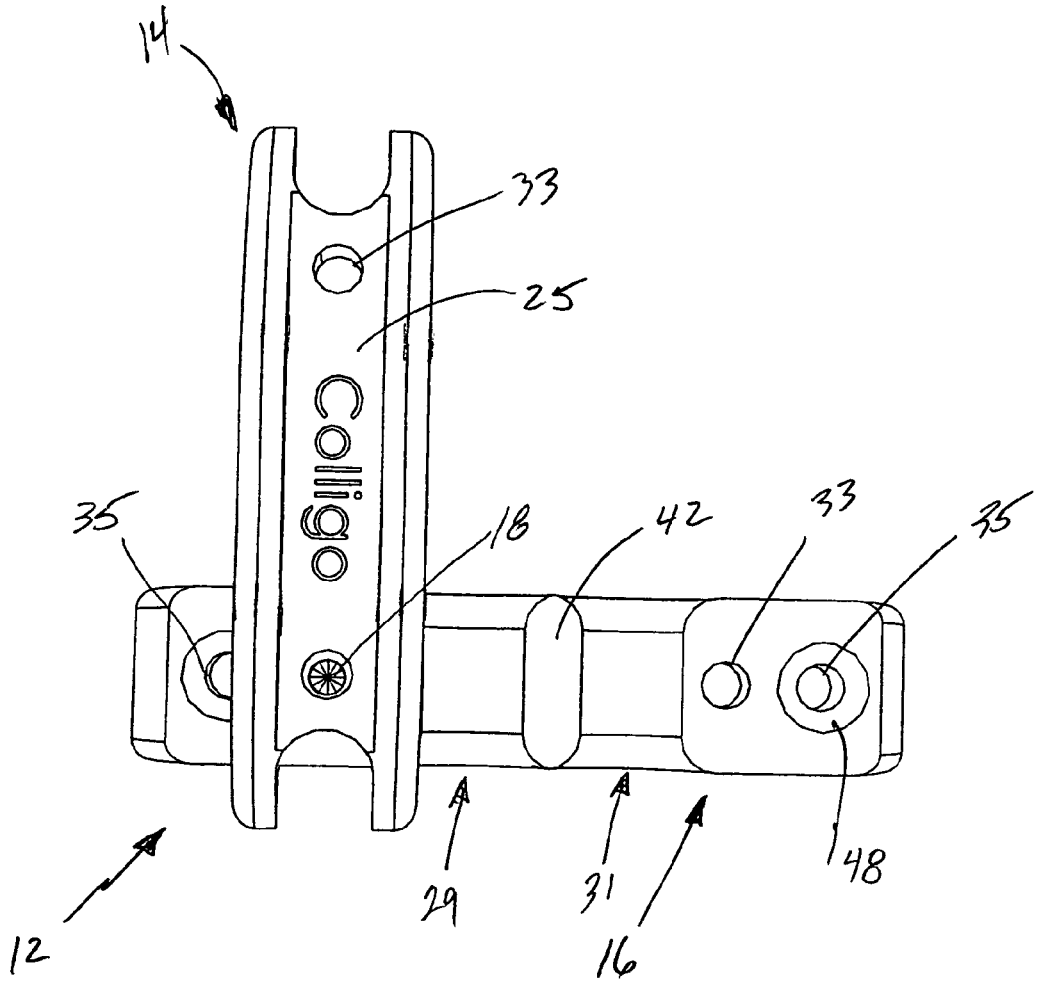
FIG. 6 a top view of another embodiment of a line guide open to receive line.

FIG. 6 shows another embodiment of the line guide 12. In this embodiment, the top half does not pivot in a vertical direction, but in a horizontal direction. The top half 14 pivots around the pivot pin 18. The bottom half 16 has fastening holes 35 located near the ends for securing the line guide 12 to a fixed surface. The fastening holes 35 also have chamfers 48 such that the heads of the screws or fasteners remain below the top 42 of the bottom half 16 and the top half 14 can rotate around the pivot pin 18. This allows the user to insert the lines into the first and second holes 29, 31, FIG. 7, for retention.

Figure 7:
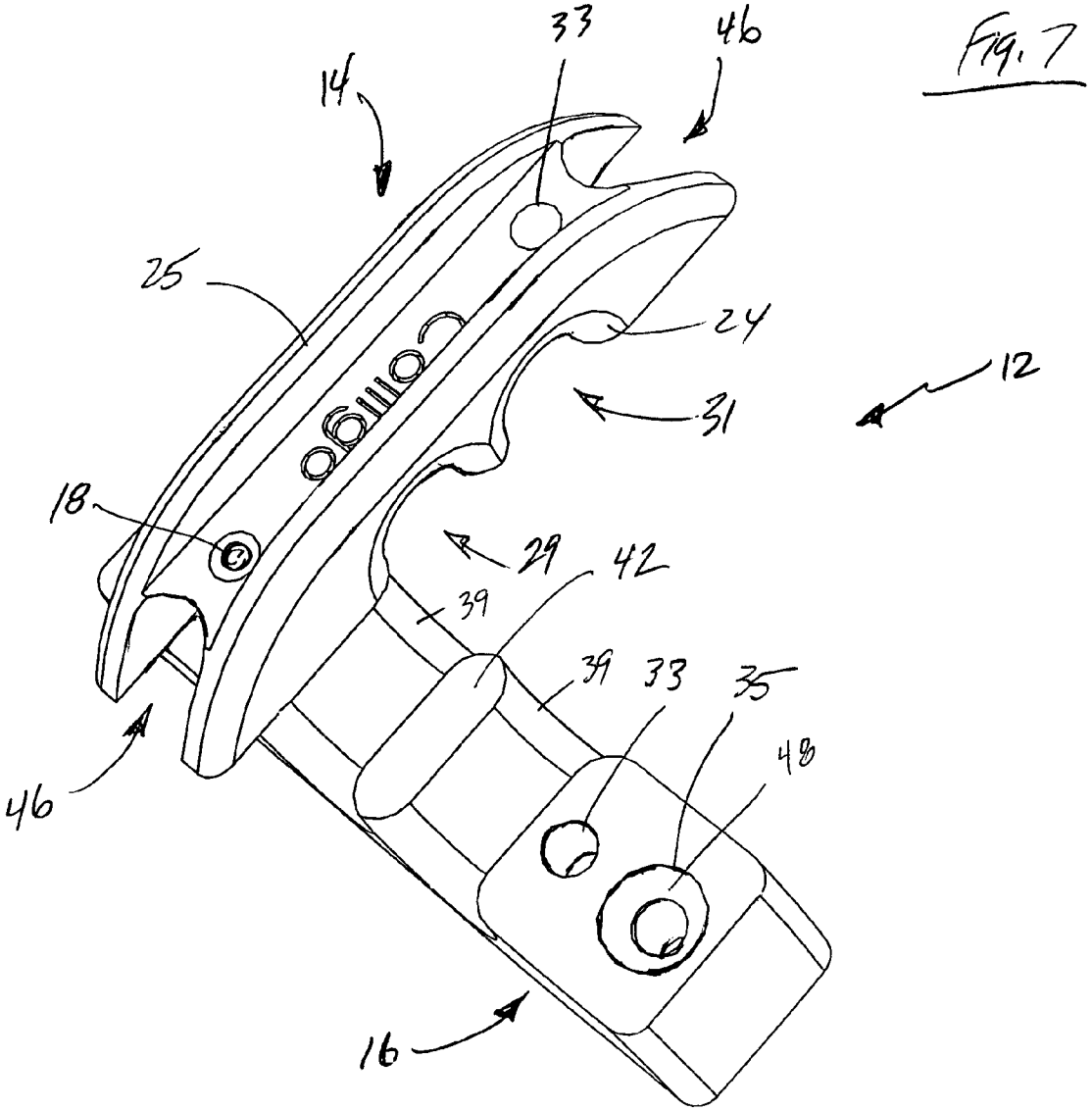
FIG. 7 shows a top perspective view of the line guide shown in FIG. 6 partially open to receive line.

FIG. 7 shows a top perspective view of a line guide 12 which better shows the horizontal rotation of the top half 14 relative to the bottom half 16. This embodiment of the line guide 12 is secured with fasteners (not shown) inserted into the fastening holes 35. A retention pin 20, FIG. 1, is inserted into the retention hole 33 to secure the top half 14 to the bottom half 16 and prevent rotation of these elements relative to one another.

Figure 8:
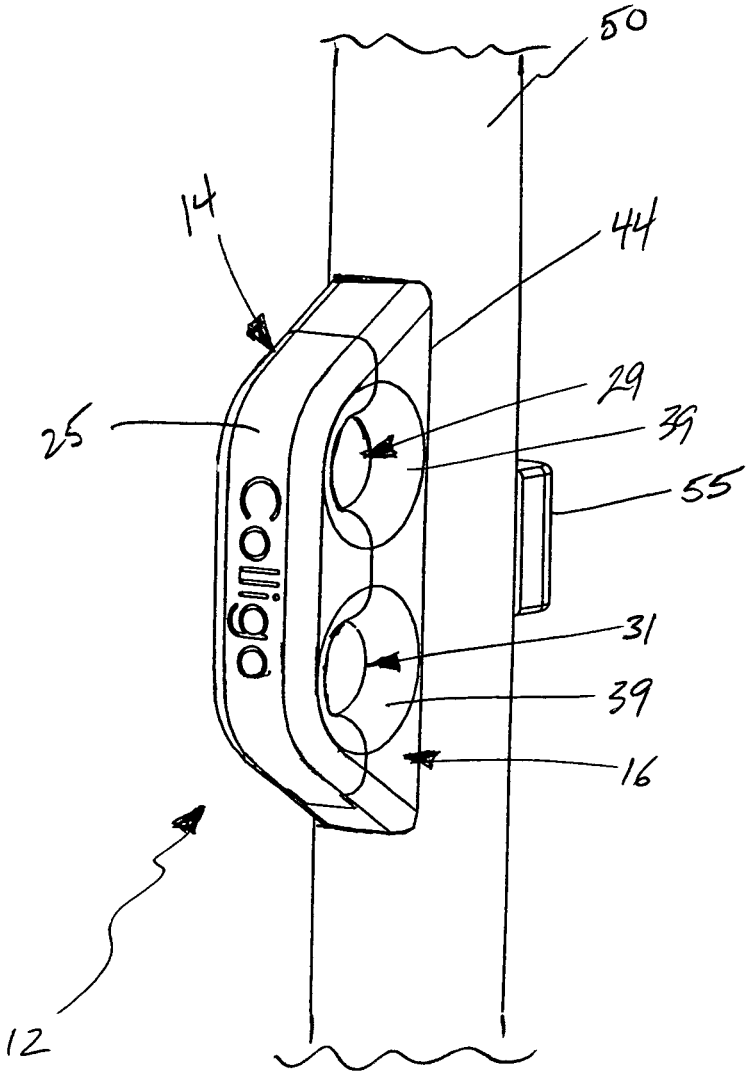
FIG. 8 shows a side perspective view of another embodiment of a closed line guide that attaches to a post or stanchion.
Figure 9:
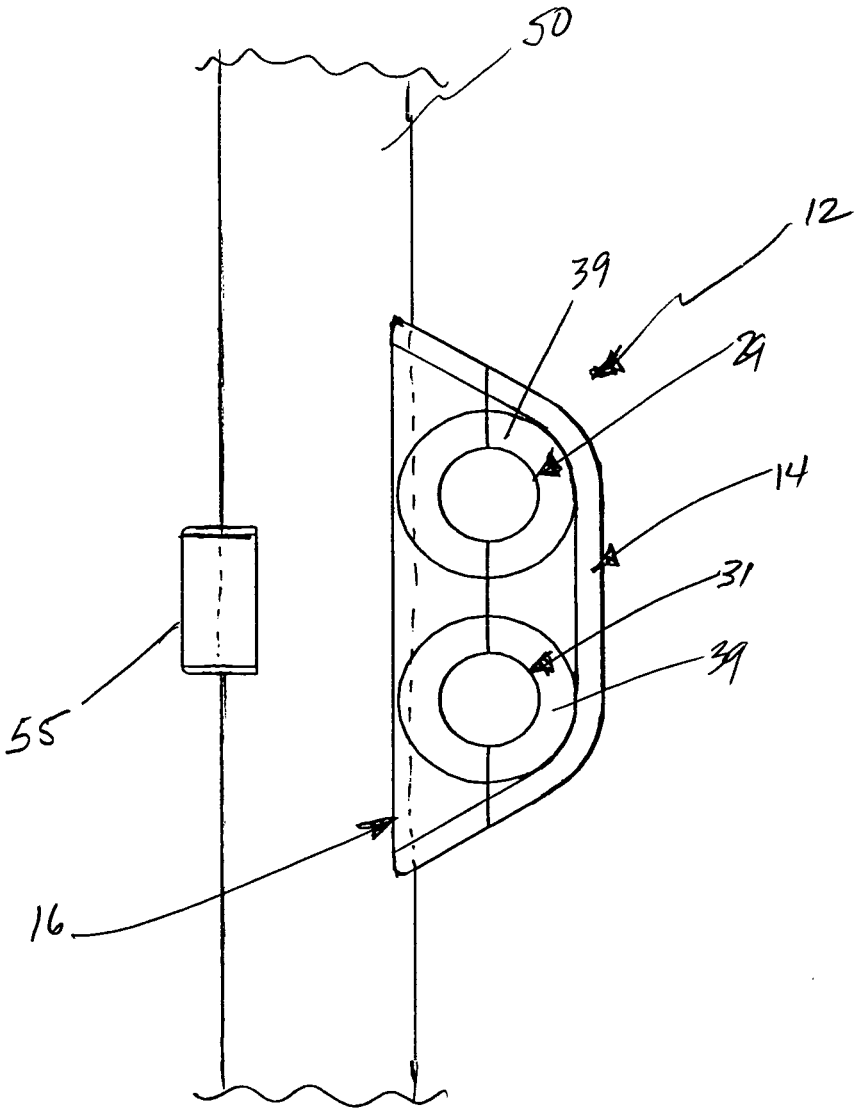
FIG. 9 shows a side view of an embodiment of the line guide that attaches to a post or stanchion.
Figure 10:
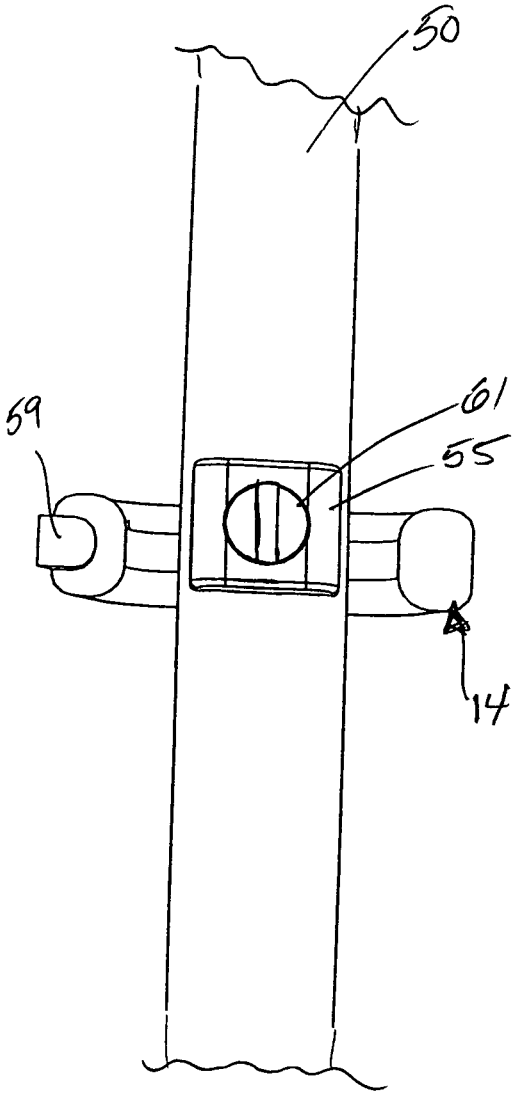
FIG. 10 shows a bottom view of an embodiment of the line guide attached to a post or stanchion with the line guide open to receive line.
Figure 11:
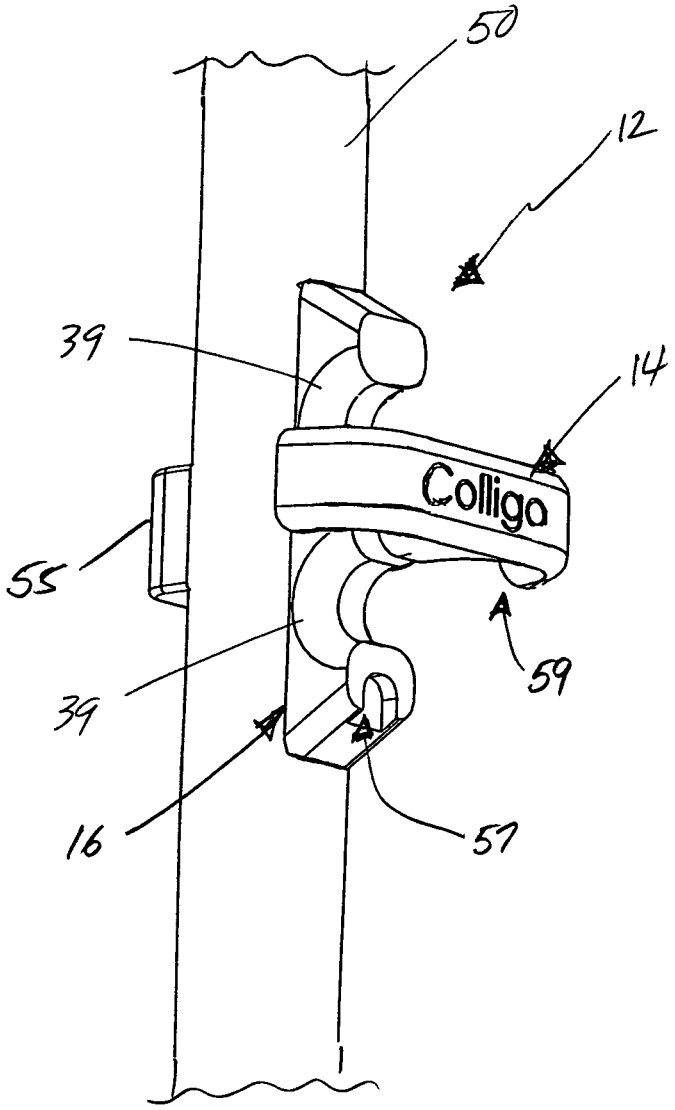
FIG. 11 shows a side perspective view of an embodiment of the line guide attached to a post or stanchion with the line guide open to receive line.

FIG. 8 shows a side perspective view of another embodiment of the line guide 12 affixed to a post or stanchion 50. The line guide 12 is attached with a plate 55 and fastener 61 on the back of the post or stanchion 50, FIG. 10. The fastener 61 also provides a pivot point for the top half 14 of the line guide 12, FIG. 10. The top half 14 has a tab 59 on one end. The tab 59 fits into a slot 57 best shown in FIG. 11.

To attach a line guide 12 to a post or stanchion 50, the user would drill a hole in the post or stanchion 50, insert the fastener 61 through the plate 55 and hole (not shown) in the stanchion 50. The fastener 61 would then be inserted into a hole in the bottom half 16 and a hole in the top half 14. The hole in the top half 14 could be threaded to match the fastener 61. The tab 59 in the top half 14 is then inserted into the slot 57 in the bottom half and the fastener 61 fully tightened thereby securing the top half 14 to the bottom half 16 and both the top and bottom halves 14, 16 to the stanchion 50 and the plate 55. This is very useful for securing a line guide 12 to a post or stanchion 50.

Figure 12:
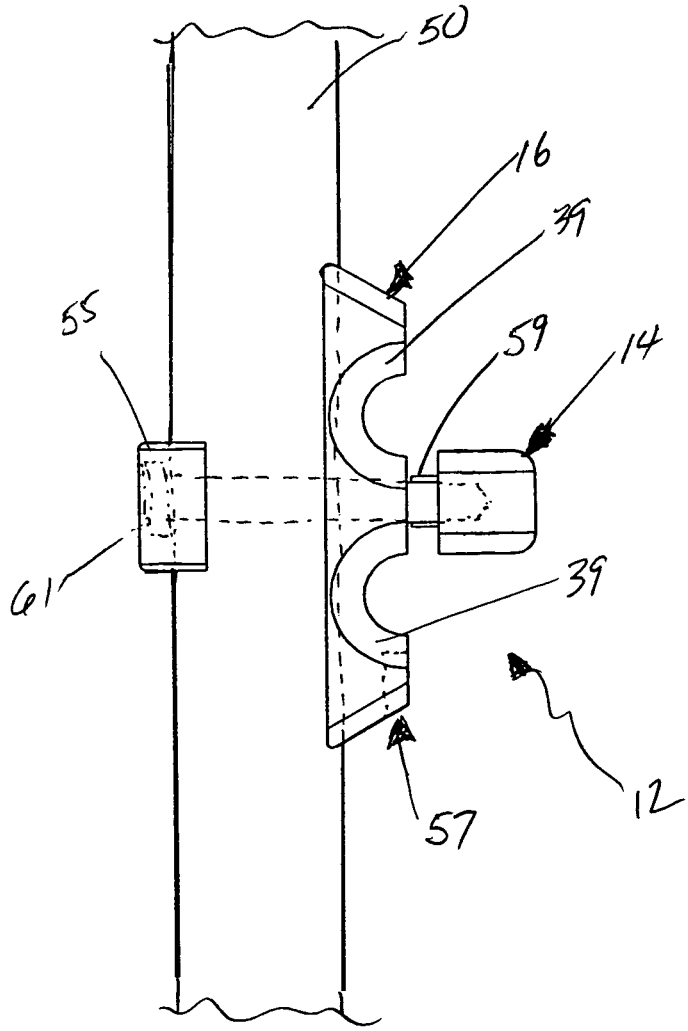
FIG. 12 shows a side view of an embodiment of the line guide attached to a post or stanchion with the line guide open to receive line.

FIG. 12 shows a side view with the top half 14 not fully secured onto the fastener 61 and elevated from the bottom half 16. This is the position that the user could insert the ropes or lines. The fastener 61 needs to be sized such that there is length to allow the top half 14 to rotate and slide the tab 59 into the slot 57

Figure 13:
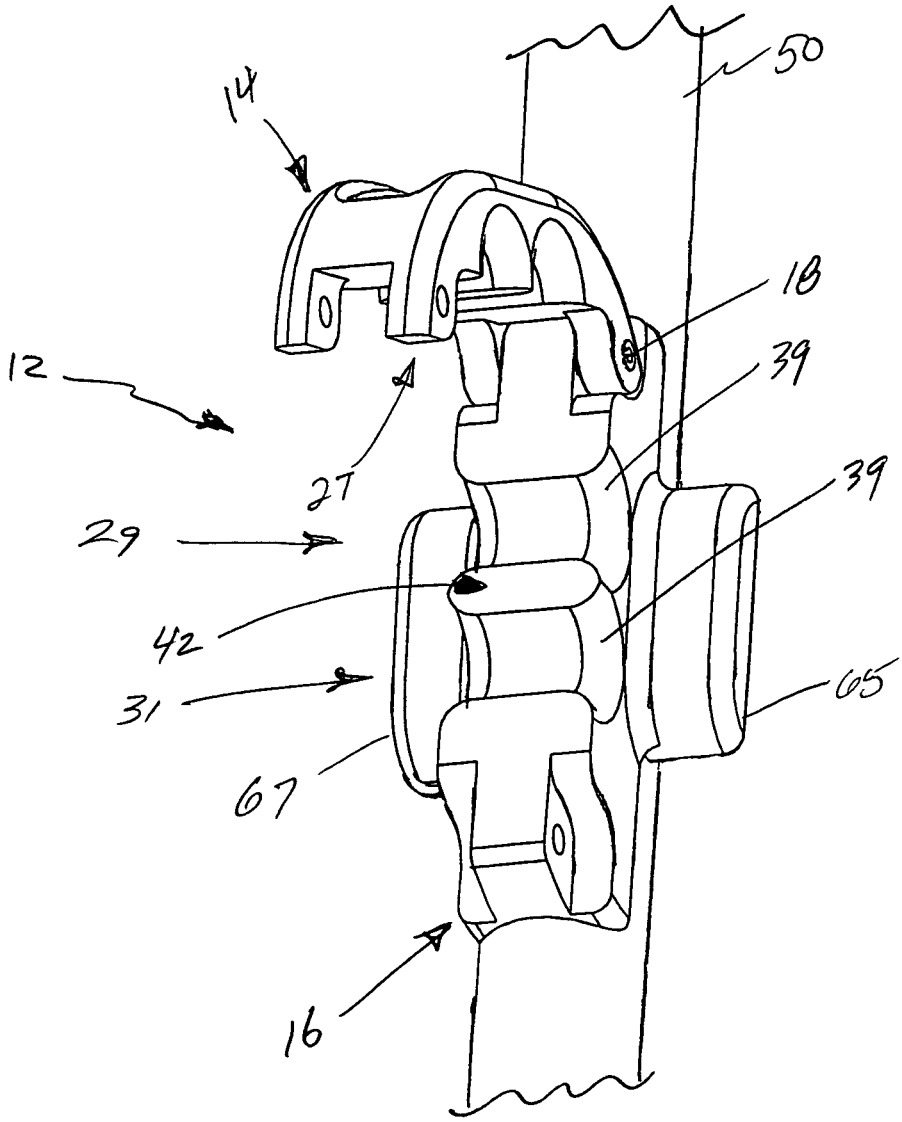
FIG. 13 shows a top perspective view of another embodiment of the line guide that can be lashed to a post or stanchion with the line guide open to receive line.

FIG. 13 shows another embodiment of the line guide 12. This embodiment has a pair of ears, first ear 65 and second ear 67 on each side of the bottom half 16. The ears 65, 67 are located approximately central to the bottom half 16 and near the bottom, see FIG. 14.

Figure 16:
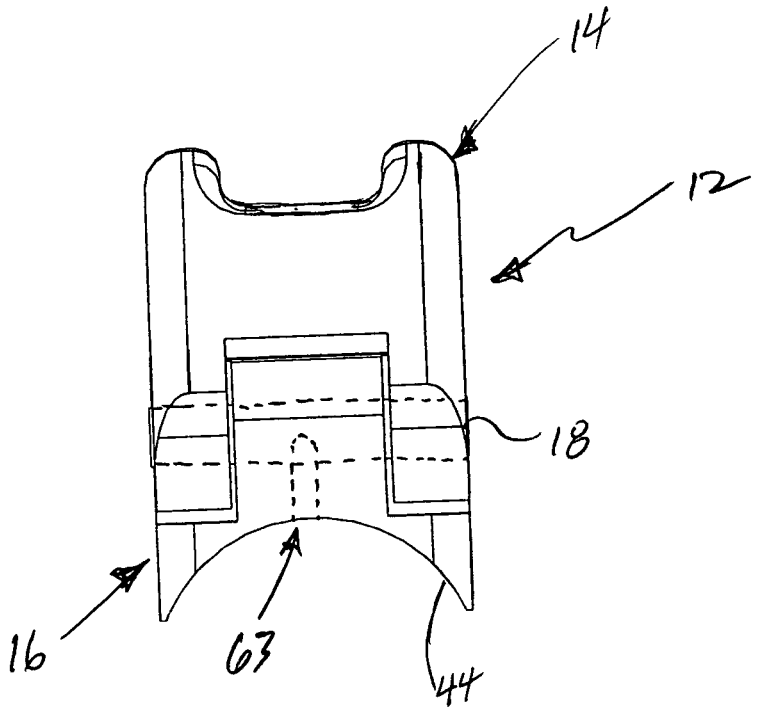
FIG. 16 shows an end view of an embodiment of the line guide that can be lashed to a post or stanchion or can be secured with a bolt, screw or fastener.

The underside of the bottom half 16 is rounded out to aid in retaining the line guide 12 to the post or stanchion 50, as shown FIG. 16.

If a user wishes to temporarily affix a line guide 12 to a post or stanchion 50 or does not wish to drill into the post or stanchion 50, then this embodiment of the line guide can be lashed to the post or stanchion 50. The lashing line, not shown, can be wrapped around the first ear 65, around the post or stanchion 50 and then around the second ear 67. The lashing line can continue to be wrapped around the ears 65, 67 and post or stanchion 50 until the line guide is secured. The top half 14 can then be rotated around pivot pin 18 and the line inserted into the first and second holes 29, 31, FIGS. 13, 14.

Figure 14:
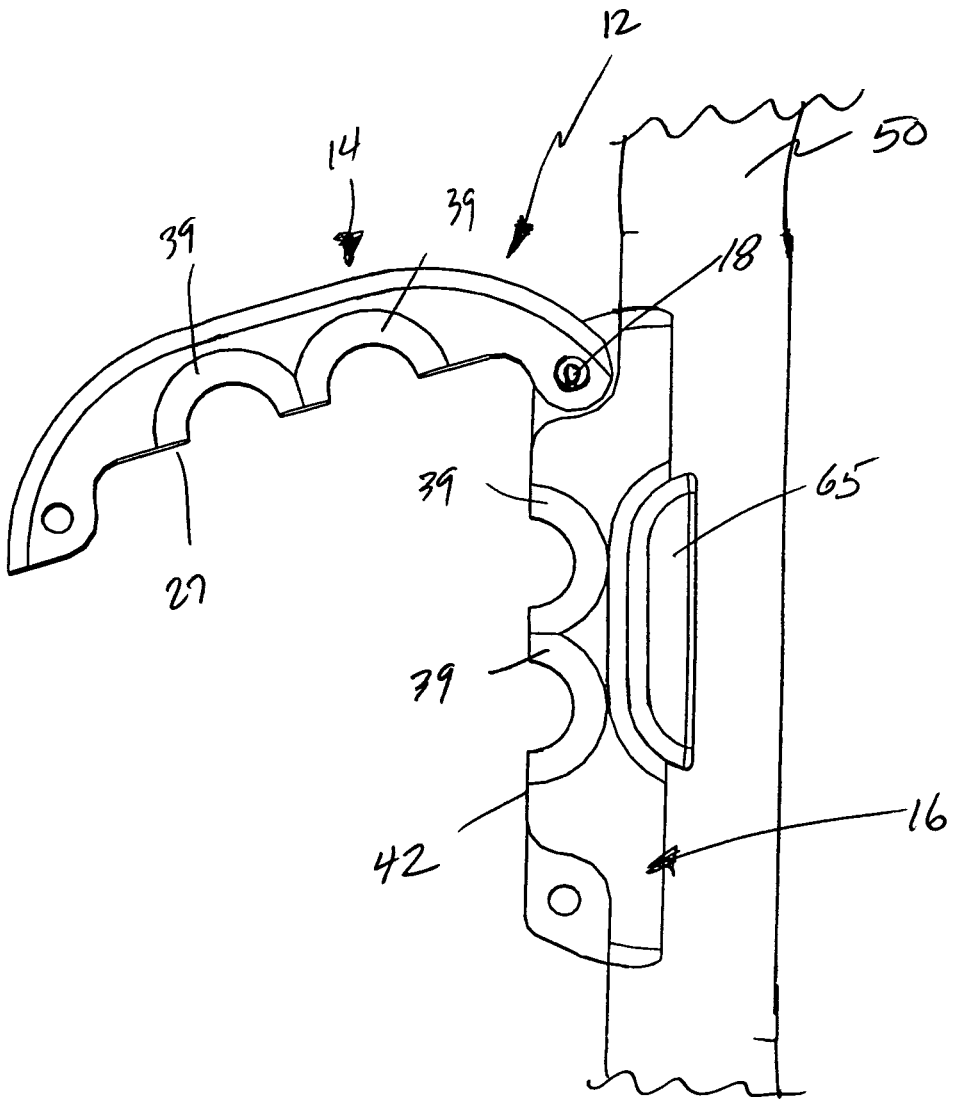
FIG. 14 shows a side view of an embodiment of the line guide that can be lashed or secured to a post or stanchion with the line guide open.

FIG. 14 shows a side view of the line guide 12 showing first ear 65 and the location relative to stanchion 50.

Figure 15:
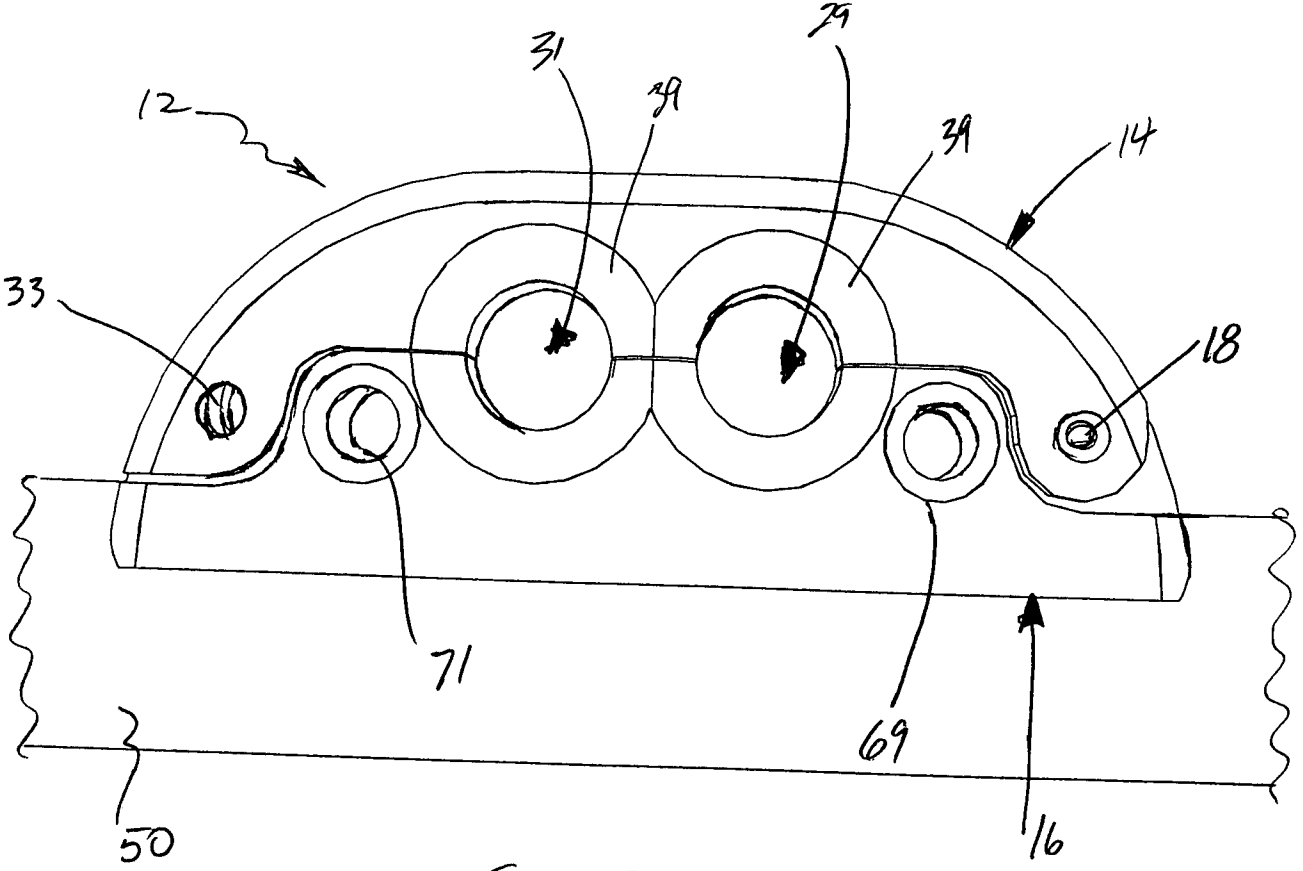
FIG. 15 shows a side view of another embodiment of the line guide that can be lashed to a post or stanchion.

FIG. 15 shows a side view of another embodiment of the line guide 12 with first lashing hole 69 and second lashing hole 71. These lashing holes 69, 71 can be used to fasten the line guide to a post or stanchion 50 also. Some users may find this method of attachment of the line guide 12 to the post or stanchion 50 preferable to the other attachment methods. The bottom half 16 of this embodiment has a bottom 44, FIG. 16, rounded to match the diameter of the stanchion 50.

FIG. 16 shows an end view of the line guide shown in FIG. 15. As can be seen, on the bottom 44 of the bottom half 16 is a fastener hole 63. This would allow the user to also use a fastener, not shown, to affix the line guide 12 to a post or stanchion 50 if they so desired either in addition to lashing this embodiment to the post or stanchion 50 or without the lashing.

Figure 17:
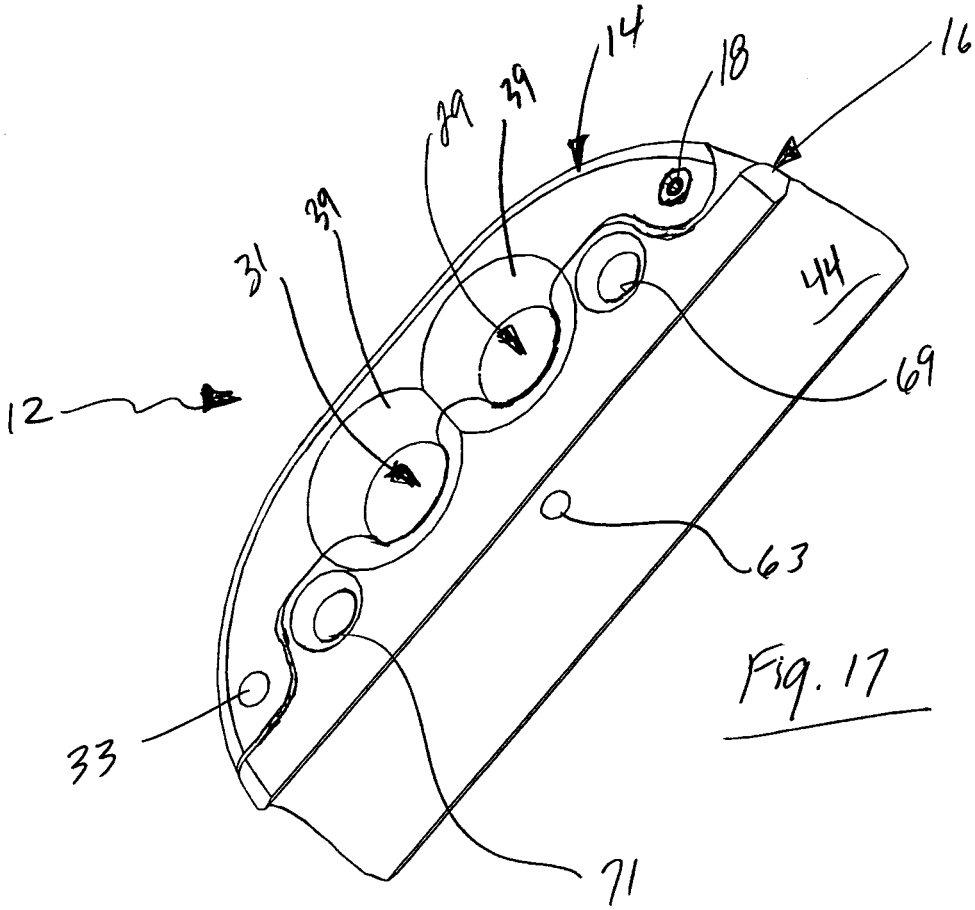
FIG. 17 shows a bottom perspective view of an embodiment of the line guide that can be lashed to a post or stanchion or can be secured with a bolt, screw or fastener.

FIG. 17 shows a bottom perspective view of the line guide 12 shown in FIGS. 15 and 16.

It will now be apparent to those skilled in the art that other embodiments, improvements, details and uses can be made consistent with the letter and spirit of the foregoing disclosure and within the scope of this application including the claims.

What is claimed is:

1. A line guide for retaining lines, the line guide comprising:

a top half, the top half having a top and a bottom, a first end and a second end, a first side and a second side, a pair of fingers on each of the first and second ends with a void there between, a co-linear retention hole through each of the fingers, two chamfers between the first and second ends on each of the first and second sides, each chamfer located near the bottom and each chamfer circumscribing a semi-circular hole through the top half;

a bottom half, the bottom half having a top and a bottom, a first end and a second end, a first side and a second side, a boss on each of the first and second ends, a boss hole, two chamfers between the first and second ends on each of the first and the second sides, each chamfer located near the top and circumscribing a semi-circular hole through the bottom half, at least one fastening hole in the bottom terminating at the top, a chamfer circumscribing the fastening hole at the top;

a pivot pin, the pivot pin inserted into the retention holes in the first end of the top half and the boss hole in the first end of the bottom half, the pivot pin allowing relative movement of the top half relative to the bottom half, closing the bottom of the top half against the top of the bottom half locates the semi-circular holes in the top half with the semi-circular holes in the bottom half together forming a first hole and a second hole through the line guide for retaining the lines; and a retention pin, the retention pin for removable insertion into the retention holes in the second end of the top half and the boss hole in the second end of the bottom half, the retention pin for retaining the top half and the bottom half together, whereby removing the retention pin allows the top half to rotate around the pivot pin relative to the bottom half for the insertion and removal of the lines.

2. The line guide of claim 1, wherein:

two fastening holes in the bottom of the bottom half and two chamfers in the top of the bottom half circumscribing the fastening holes.

3. The retention pin of claim 1, further comprising:

a ball and spring located in the distal end for securing the retention pin in the line guide.

4. The fastening hole chamfer of claim 1, wherein:

the chamfer sized such that the head of the fastener is located below the top of the bottom half when the line guide is secured to a fixed surface.

5. A device for selectively securing and removing lines with respect to a fixed surface, the device comprising:

a two piece device having a top half and a bottom half;

the top half having a top and a bottom, a first end and a second end, a first side and a second side, a pair of fingers on the first end and a pair of fingers on the second end, each pair of fingers having a void there between, a co-linear retention hole through each pair of fingers, a pair of chamfers on the first side near the bottom, a pair of chamfers on the second side near the bottom, the chamfers circumscribing a semi-circular hole through the first side to the second side;

a bottom half having a top and a bottom, a first end and a second end, a first side and a second side, a boss on the first end and a boss on the second end, a boss hole through each boss, a pair of chamfers on the first side near the top, a pair of chamfers on the second side near the top, the chamfers circumscribing a semi-circular hole through the first side to the second side, at least one fastening hole in the bottom terminating at the top for receiving a fastener, a chamfer circumscribing the fastening hole at the top;

a pivot pin, the pivot pin located and fixed in the fingers on the first end of the top half and the boss hole on the first end of the bottom half;

a retention pin, the retention pin removably located in the fingers on the second end of the top half and the boss hole on the second end of the bottom half; and whereby locating the bottom of the top half and the top of the bottom half together forms a first hole and a second hole from the first side of the top and bottom half through to the second side of the top and bottom half for retaining one line in each hole.

6. The device of claim 5, further comprising:

two fastening holes in the bottom of the bottom half and two chamfers in the top of the bottom half circumscribing the fastening holes.

7. The retention pin of claim 5, further comprising:

a ball and spring located in the distal end for securing the retention pin in the device.

8. The fastening hole chamfer of claim 5, wherein:

the chamfer sized such that the head of the fastener is located below the top of the bottom half when the device is secured to a fixed surface.

9. A device for retaining lines to a fixed surface, the device comprising:

a top half and a nesting bottom half, the top half having a top and a bottom, a first end and a second end, a first side and a second side, a pair of fingers on the first end, a pair of fingers on the second end, a co-linear retention hole through both of the fingers on the first end, a co-linear retention hole through both of the fingers on the second end, a pair of chamfers located near the bottom of the first side, a pair of chamfers located near the bottom of the second side, the chamfers on the first side circumscribing a pair of semicircular cutouts, the chamfers on the second side circumscribing a pair of semicircular cutouts, the cutouts on the first side aligning with the cutouts on the second side forming a semicircular hole there through;

the bottom half having a top and a bottom, a first end and a second end, a first side and a second side, a boss on the first end, a boss on the second end, a boss hole through the boss on the first end, a boss hole through the boss on the second end, a pair of chamfers located near the top of the first side, a pair of chamfers located near the top of the second side, the chamfers on the first side circumscribing a pair of semicircular cutouts, the chamfers on the second side circumscribing a pair of semicircular cutouts, the cutouts on the first side aligning with the cutouts on the second side forming a semicircular hole there through, at least one fastening hole from the bottom of the bottom half to the top of the bottom half for receiving a fastener, a chamfer circumscribing the fastening hole at the top of the bottom half;

a pivot pin, the pivot pin inserted into the retention hole of one finger of the top half first end into the boss hole of the boss of the bottom half first end and into the second finger of the top half first end thereby rotatably securing the top half to the bottom half;

a retention pin, the retention pin insertable into the retention hole of the finger on the second end of the top half through the boss hole of the second end of the bottom half and into the retention hole of the second finger on the second end of the top half thereby securing the top half to the bottom half; and whereby when the top half is secured to the bottom half, the semicircular cutouts form a first hole and second hole through the device for the retention of lines.

10. The device of claim 9, further comprising:

two fastening holes in the bottom of the bottom half and two chamfers in the top of the bottom half circumscribing the fastening holes.

11. The retention pin of claim 10, further comprising:

a ball and spring located in the distal end for securing the retention pin in the device.

12. The fastening hole chamfer of claim 10, wherein:

the chamfer sized such that the head of the fastener is located below the top of the bottom half when the device is secured to a fixed surface.

* * * * *